US010765287B2

(12) United States Patent
Li

(10) Patent No.: US 10,765,287 B2
(45) Date of Patent: Sep. 8, 2020

(54) CLEANING ROBOT

(71) Applicant: HiZero Technologies Co., Ltd., Shenzhen (CN)

(72) Inventor: Yang Li, Guangdong (CN)

(73) Assignee: HiZero Technologies Co., Ltd., Shenzhen (CN)

( * ) Notice: Subject to any disclaimer, the term of this patent is extended or adjusted under 35 U.S.C. 154(b) by 78 days.

(21) Appl. No.: 16/036,003

(22) Filed: Jul. 16, 2018

(65) Prior Publication Data

US 2019/0343362 A1 Nov. 14, 2019

Related U.S. Application Data

(63) Continuation-in-part of application No. PCT/CN2018/086610, filed on May 11, 2018.

(51) Int. Cl.
*A47L 11/40* (2006.01)

(52) U.S. Cl.
CPC ..... *A47L 11/4063* (2013.01); *A47L 11/4011* (2013.01); *A47L 11/4075* (2013.01); *A47L 2201/04* (2013.01)

(58) Field of Classification Search
CPC ..... A47L 11/4063; A47L 11/4011; A47L 11/4075; A47L 2201/04
See application file for complete search history.

(56) References Cited

U.S. PATENT DOCUMENTS 7,362,064 B2 * 4/2008 Coates ..... A47L 11/03 15/319
7,487,569 B2 2/2009 Zahuranec et al.
2002/0073505 A1 6/2002 Bolden
2004/0134018 A1 7/2004 Conner et al.
2010/0107357 A1 5/2010 Odachi et al.
2016/0302636 A1 * 10/2016 Kim ..... A47L 9/1683
(Continued)

FOREIGN PATENT DOCUMENTS

CN 200973683 Y 11/2007
CN 205181257 U 4/2016
CN 205359367 U 7/2016
(Continued)

OTHER PUBLICATIONS

Corresponding Great Britain Patent Application No. GB1813583.0, Great Britain Search Report dated Jan. 31, 2019.
(Continued)

*Primary Examiner* — Marc Carlson
(74) *Attorney, Agent, or Firm* — Cooper Legal Group, LLC

(57) ABSTRACT

The disclosure relates to a cleaning robot (10). The cleaning robot (10) comprises a cleaning body (20) and an adjustment mechanism (30). The cleaning body (20) comprises a handle (100) and a working assembly (200), and the working assembly (200) is provided at one end of the handle (100), the working assembly (200) includes a roller (210) and a first driving mechanism (220), and the first driving mechanism (220) can drive the roller (210) to rotate relative to the handle (100). The adjustment mechanism (30) is connected with the first driving mechanism (220), and the adjustment mechanism (30) can adjust the rotational direction and rotational speed of the roller (210) by controlling the first driving mechanism (220).

16 Claims, 5 Drawing Sheets

(56) References Cited

U.S. PATENT DOCUMENTS

| | | | | |
|---|---|---|---|---|
| 2017/0325647 | A1* | 11/2017 | Kwak | A47L 9/009 |
| 2018/0125321 | A1 | 5/2018 | Weis et al. | |

FOREIGN PATENT DOCUMENTS

| | | | |
|---|---|---|---|
| CN | 107529929 | A | 1/2018 |
| JP | 48054463 | | 7/1973 |
| JP | H01185233 | A | 7/1989 |
| JP | 2006240361 | A | 9/2006 |
| JP | 2012000121 | A | 1/2012 |
| JP | 2012000166 | A | 1/2012 |
| JP | 2013182491 | A | 9/2013 |
| JP | 2015192836 | A | 11/2015 |
| JP | 2018510042 | A | 4/2018 |
| KR | 1020060107464 | A | 10/2006 |
| WO | 2015084031 | A1 | 6/2015 |
| WO | 2017173553 | A1 | 10/2017 |

OTHER PUBLICATIONS

Corresponding European Patent Application No. 18250016.5, European Extended Search Report dated Mar. 22, 2019.
Corresponding Japanese Patent Application No. 2018-219915, Japanese Office Action dated Nov. 6, 2019. English Translation.
Corresponding Japanese Patent Application No. 2018-219915, Japanese Office Action dated Jun. 4, 2020.

* cited by examiner

CLEANING ROBOT

RELATED APPLICATIONS

This application is a continuation-in-part of and claims priority to PCT/CN2018/086610, filed on May 11, 2018, which is incorporated herein by reference.

FIELD OF THE DISCLOSURE

The present disclosure relates to a cleaning robot.

BACKGROUND OF THE DISCLOSURE

With the development of the level of science and technology and the ever-increasing improvement of people's living standards, clean robots have become more and more widely used. In the process of using a conventional cleaning robot, people hold the handle of the cleaning robot and push and pull the cleaning robot forward and backward. However, due to the friction between the roller and the floor of the cleaning robot, people need to overcome the friction when pushing and pulling the cleaning robot, which is laborious.

SUMMARY OF THE DISCLOSURE

Based on this, it is necessary to provide a relatively labor-saving cleaning robot. A cleaning robot includes: the cleaning body, including a handle and a working assembly. The working assembly is disposed at one end of the handle. The working assembly includes a roller and a first driving mechanism. The first driving mechanism can drive the roller to rotate relative to the handle as well as an adjustment mechanism that is connected with the first drive mechanism. The adjustment mechanism can adjust the rotational direction and rotational speed of the roller by controlling the first drive mechanism.

BRIEF DESCRIPTION OF THE DRAWINGS

In order to more clearly explain the embodiments of the present disclosure or the technical solutions relative to the prior art, the drawings to be used in the description of the embodiments or the prior art will be briefly described below. Obviously, the drawings in the following description are only some embodiments of the present disclosure. For those skilled in the art, drawings of other embodiments can also be obtained based on these drawings without any creative work.

DETAILED DESCRIPTION OF THE EMBODIMENTS

To facilitate the understanding of the present disclosure, the present disclosure will be described more fully hereinafter with reference to the accompanying drawings. The preferred embodiments of the present disclosure is given in the accompanying drawings. However, the present disclosure may be embodied in many different forms and is not limited to the embodiments described herein. Rather, these embodiments are provided so that this disclosure will be thorough and complete. It should be noted that when an element is referred to as being "fixed" to another element, it may be directly on the other element or there may also be an intervening element. When an element is considered to be "connected" to another element, it can be directly connected to another element or there may be an intervening element. The terms "vertical", "horizontal", "left", "right" and the like are used herein for the purpose of illustration only. Unless otherwise defined, all technical and scientific terms used herein have the same meaning as commonly understood by one of ordinary skill in the art to which this disclosure belongs. The terminology used in the description of the present disclosure herein is for the purpose of describing particular embodiments only and is not intended to limit the present disclosure. As used herein, the term "and/or" includes any and all combinations of one or more of the associated listed items.

Figure 1:
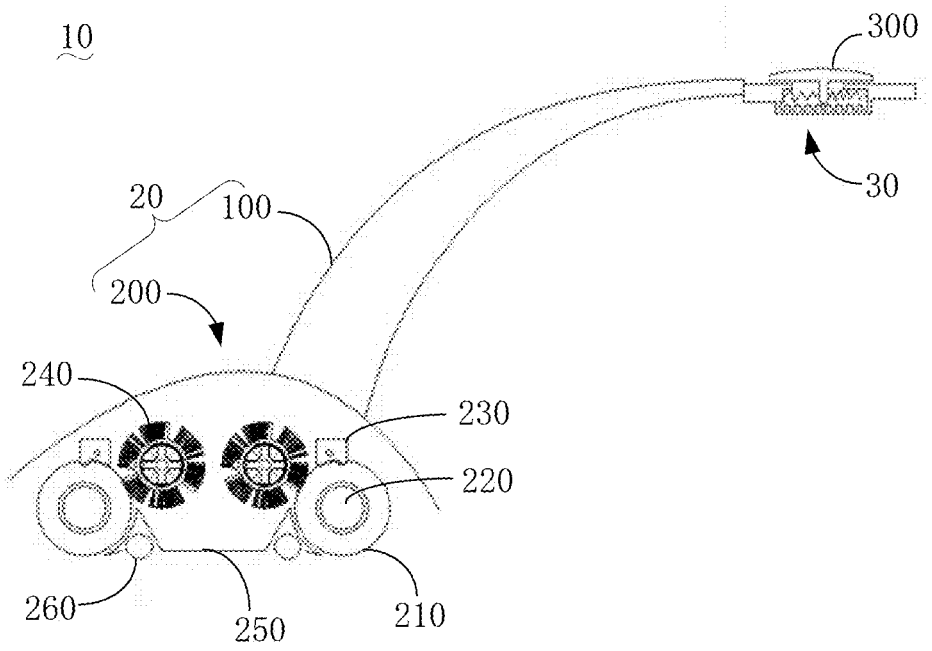
FIG. 1 is a schematic structural view of a cleaning robot according to a first embodiment.

As shown in FIG. 1, the cleaning robot 10 of an embodiment includes a cleaning body 20 and an adjustment mechanism 30. The cleaning body 20 is used to clean the floor. The adjustment mechanism 30 can adjust the walking direction and the walking speed of the cleaning body 20. The adjustment mechanism 30 can be set. The cleaning body 20 can also be wirelessly connected to the adjustment mechanism 30 by remote control. Specifically, the cleaning body 20 includes a handle 100 and a working assembly 200 disposed at one end of the handle 100. The end of the handle 100 away from the working assembly 200 is flat and is convenient for a human hand to hold, and the central portion has a certain degree of curvature in order to make the design of the clean body 20 more ergonomic. The working assembly 200 includes a roller 210 and a first driving mechanism 220. The roller 210 is made of a flexible material such as a sponge and has good water absorption. The first driving mechanism 220 can drive the roller 210 to rotate relative to the handle 100. The first driving mechanism 220 can be a brushless motor or a brush motor.

The adjustment mechanism 30 is connected with the first drive mechanism 220, and the adjustment mechanism 30 can adjust the rotational direction and rotational speed of the roller 210 by controlling the first drive mechanism 220.

Figure 2:
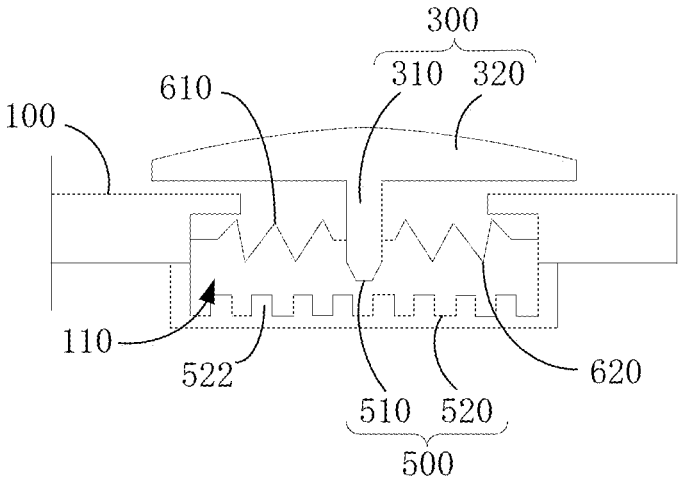
FIG. 2 is a schematic structural view of an adjustment mechanism in the cleaning robot shown in FIG. 1.
Figure 3:
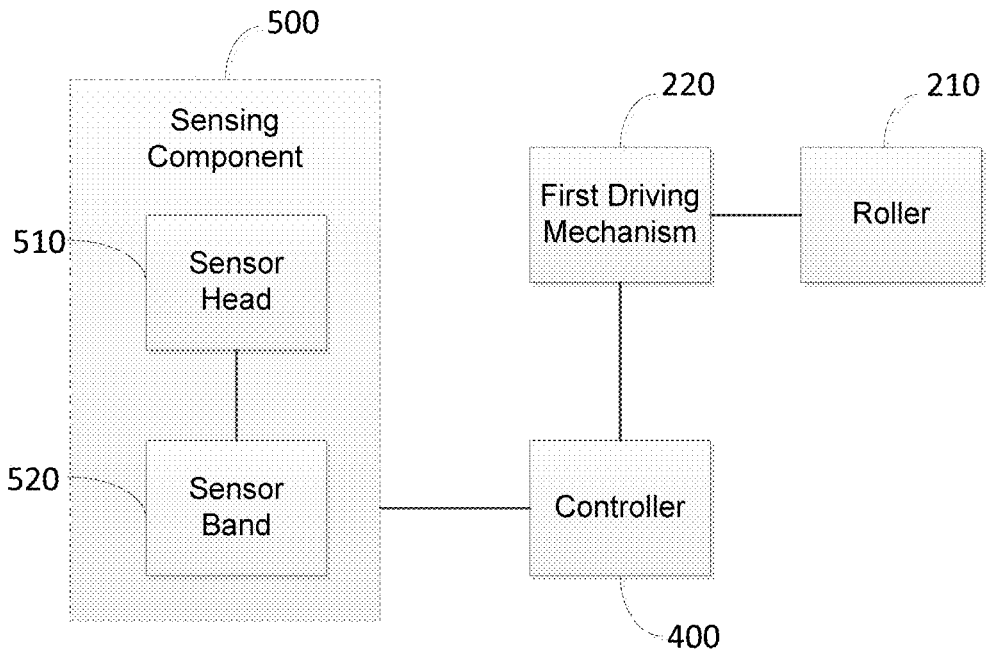
FIG. 3 is a block diagram of a partial structure of the cleaning robot shown in FIG. 1.

As shown in FIG. 2 and FIG. 3, the adjustment mechanism 30 includes a movable member 300 and a controller 400. The movable member 300 is disposed at an end of the handle 100 away from the working assembly 200. The movable member 300 is slidable relative to the handle 100, and the movable member 300 is opposite to the handle 100. When the handle 100 slides, the controller 400 can control the rolling state of the roller 210; that is, the controller 400 can control the rotational direction and rotational speed of the roller 210. When the movable member 300, in an initial position, is pushed forward with the user's position using the cleaning robot 10 as a reference, the roller 210 rotates in the forward direction; that is, the cleaning body 20 moves forward and the movable member 300 moves forward. The greater the distance, the greater the rotational speed of the roller 210. Conversely, when the movable member 300 in the initial position is pushed backward, the roller 210 rotates in the reverse direction; that is, the cleaning body 20 moves backward. The larger the distance of the movable member 300 moving backward, the greater the rotational speed of the roller 210. Therefore, when cleaning the floor, the user only needs to slide the movable member 300 to adjust the cleaning direction and speed of the cleaning body 20, which is convenient and effortless.

In an embodiment, the movable member 300 includes a first sliding portion 310 and a second sliding portion 320 that are connected to each other. The handle 100 is provided with a groove 110. The first sliding portion 310 is disposed in the groove 110, and the second sliding portion 320 is formed outside the groove 110. The adjustment mechanism 30 further includes a sensing component 500 connected to the controller 400. The sensing component 500 includes a sensor head 510 and a sensor band 520. The sensor head 510 is disposed on the first sliding portion 310, and the sensor band 520 is located on a bottom wall of the groove 110. A plurality of spaced-apart nodes 522 are disposed on the sensor band 520. When the movable member 300 slides relative to the handle 100, the sensor head 510 can correspond to different nodes 522, so that the controller 400 can change the rolling state of the roller 210. As shown in FIG. 2 as the viewing angle, there are a total of 8 nodes on the sensor band 520. In order from left to right, it is assumed that the eight nodes correspond to +4, +3, +2, +1, −1, −2, −3, and −4, respectively. When the sensor head 510 is located between the +1 node and the −1 node, the movable member 300 is in the initial position, and at this time, the roller 210 does not rotate. When the sensor head 510 is located between any two nodes from +1 to +4, the roller 210 rotates clockwise to achieve the advancement of the cleaning body 20. In addition, the further leftward the movable member 300 is with respect to the initial position, the greater the rotational speed of the roller 210. When the sensor head 510 is located between any two nodes between −1 and −4, the roller 210 rotates counterclockwise to achieve the retraction of the cleaning body 20. In addition, the movable member 300 is positioned further to the right with respect to the initial position, and the rotational speed of the roller 210 is larger.

It can be understood that the number of nodes 522 may be an even number or an odd number. When the number of nodes 522 is an even number, the initial position of the sensor head 510 is between two intermediate nodes. When the number of nodes 522 is an odd number, the initial position of the sensor head 510 corresponds to one node in the middle. In this embodiment, the adjustment mechanism 30 further includes a telescoping assembly connected with the handle 100 and the movable member 300 to assist in resetting the movable member 300. Specifically, the telescoping assembly includes a first spring 610 and a second spring 620, and both the first spring 610 and the second spring 620 are accommodated in the groove 110. One end of the first spring 610 is connected with the sidewall of the groove 110, and the other end is connected with the first sliding portion 310. One end of the second spring 620 is connected with the sidewall of the groove 110, and the other end is connected with the first sliding portion 310. The first sliding portion 310 is located between the first spring 610 and the second spring 620. When the first spring 610 is compressed, the second spring 620 is elongated.

Still referring to FIG. 2 as the viewing angle, when the movable member 300 is in the initial position, both the first spring 610 and the second spring 620 are original lengths. When the movable member 300 slides to the left, the first spring 610 is compressed and the second spring 620 is elongated. When the movable member 300 is released, the movable member is acted upon by the urging force of the first spring 610 and the tension of the second spring 620. The movable member 300 can return to the initial position in time. Similarly, when the movable member 300 slides to the right, the movable member 300 can be restored to the initial position in time under the joint action of the first spring 610 and the second spring 620, so that the action of manually resetting the movable member 300 can be reduced. Moreover, the first spring 610 and the second spring 620 can also act as a buffer to prevent the movable member 300 from resetting excessively beyond the initial position and causing the roller 210 to reverse. It can be understood that in this embodiment, the first spring 610 and the second spring 620 may be omitted.

In one embodiment, referring to FIG. 1 and FIG. 4 to FIG. 6, the rolling state of the roller 210 may also be controlled by detecting the force of the sidewall of the groove 110 or the first sliding portion 310. Specifically, the adjustment mechanism 30 further includes a first force sensor 530 and a second force sensor 540. The first force sensor 530 is located at one end of the first spring 610. The first force sensor 530 may be mounted on the first spring 610 and the groove 110. The sidewalls may also be disposed between the first spring 610 and the first sliding portion 310. The second force sensor 540 is disposed at one end of the second spring 620. Similarly, the second force sensor 540 may be disposed between the second spring 620 and the sidewall of the groove 110, and may also be disposed between the second spring 620 and the first sliding portion 310. The first force sensor 530 and the second force sensor 540 are both connected to the controller 400, and the controller 400 can determine the rotational direction and rotational speed of the roller 210 based on the detection results of the first force sensor 530 and the second force sensor 540.

Figure 4:
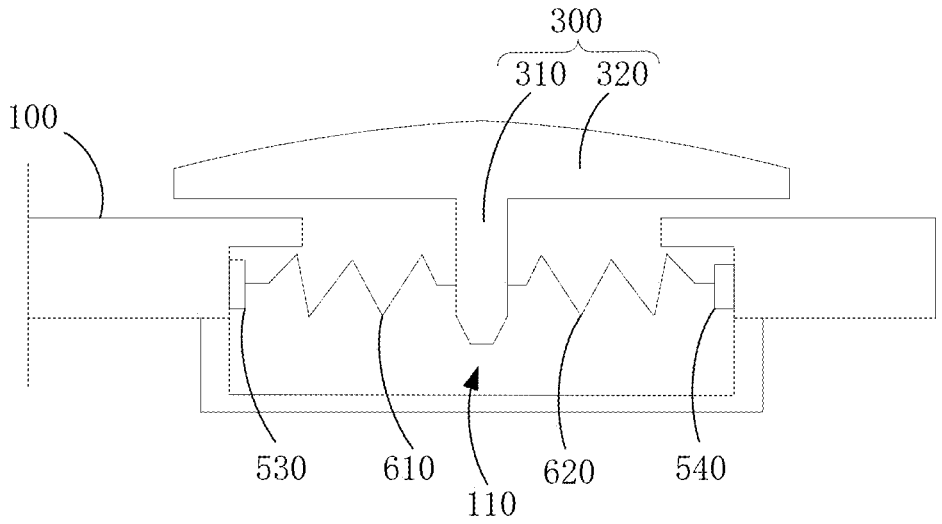
FIG. 4 is a schematic structural view of an adjustment mechanism of a cleaning robot according to a second embodiment.
Figure 5:
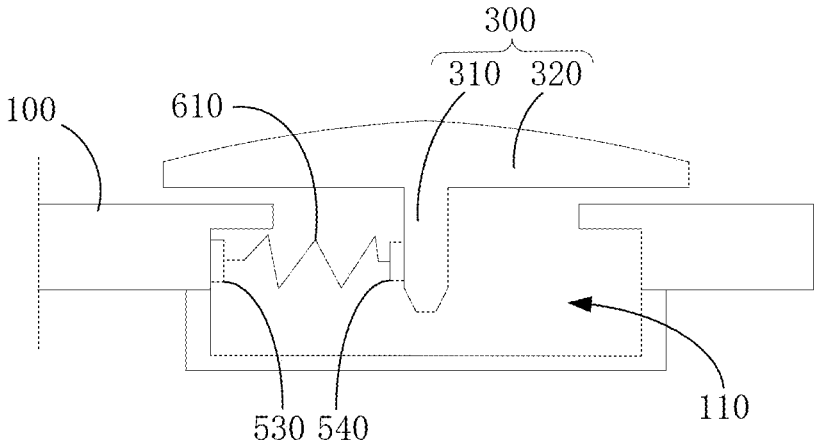
FIG. 5 is a schematic structural view of an adjustment mechanism of a cleaning robot according to a third embodiment.
Figure 6:
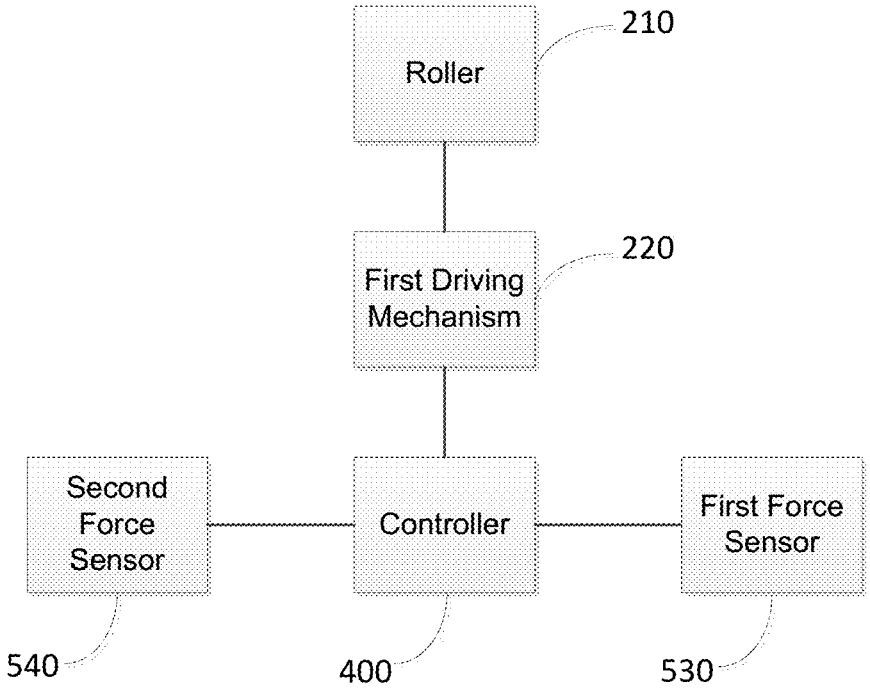
FIG. 6 is a block diagram of a partial structure of the cleaning robot shown in FIG. 4.

In this embodiment, both the first force sensor 530 and the second force sensor 540 are pressure sensors, or both the first force sensor 530 and the second force sensor 540 are tension sensors. As shown in FIGS. 1 and 4 as viewing angles, when the first force sensor 530 and the second force sensor 540 are both pressure sensors, the movable member 300 is pushed to the left, and the first force is generated because the first spring 610 is compressed. The first force sensor 530 can detect the elastic force of the first spring 610, and the second spring 620 is elongated so that the value of the second force sensor 540 does not change. The controller 400 can issue a command to rotate the roller 210 clockwise at a corresponding rotational speed based on the detection results of both. Moving the movable member 300 to the right, the working principle of the first force sensor 530, the second force sensor 540, and the controller 400 is similar to the above principle, and will not be repeated here.

When both the first force sensor 530 and the second force sensor 540 are tension sensors, the movable member 300 is moved to the left. Because the first spring 610 is compressed, the value of the first force sensor 530 is unchanged, and the second spring 620 is changed. Being elongated, the second force sensor 540 can detect the elastic force of the second spring 620, and the controller 400 can issue an instruction that the roller 210 needs to rotate clockwise at a corresponding rotational speed according to the detection result of both. For the contrary, the same reasoning applies. Of course, it can be understood that in other embodiments, either the first spring 610 or the second spring 620 may be selected. For example, when there is only the first spring 610, the first force sensor 530 and the second force sensor 540 are provided at both ends of the first spring 610, respectively. In this case, when the first force sensor 530 is a pressure sensor, the second force sensor 540 is a tension sensor. Pushing the movable member 300 to the left, since the first spring 610 is compressed, the first force sensor 530 can detect the elastic force of the first spring 610, and the controller 400 can issue instructions instructing the roller 210 to rotate according to the detection result of the first force sensor 530. The roller 210 is therefore instructed to rotate clockwise at the corresponding speed. When the movable member 300 is pushed to the right, since the first spring 610 is elongated, the second force sensor 540 can detect the elastic force of the first spring 610, and the controller 400 can issue instructions instructing the roller 210 to rotate according to the detection result of the second force sensor 540. The roller 210 is therefore instructed to rotate counterclockwise at a corresponding rotational speed.

Figure 7:
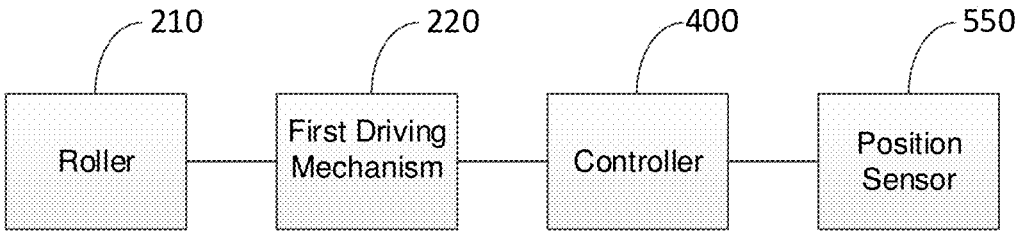
FIG. 7 is a block diagram of a partial structure of a cleaning robot according to a fourth embodiment.
Figure 8:
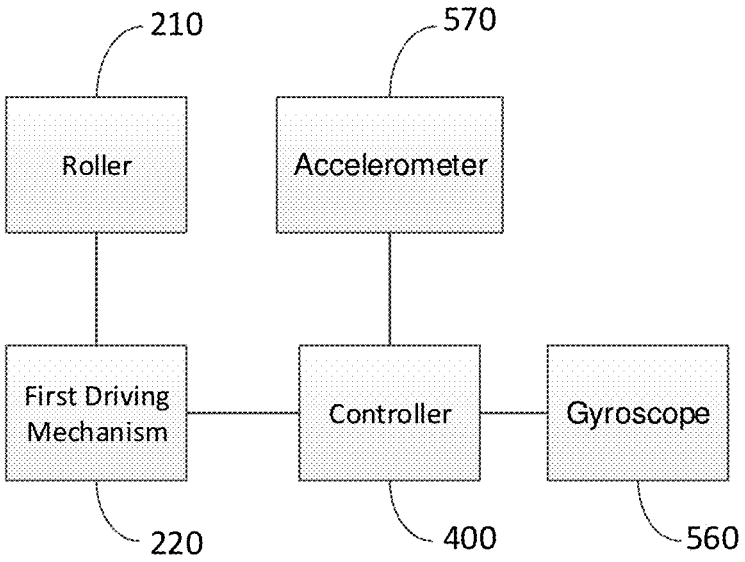
FIG. 8 is a block diagram of a partial structure of a cleaning robot according to a fifth embodiment.

Similarly, when the first force sensor 530 is a tension sensor, the second force sensor 540 is a pressure sensor. In an embodiment, as shown in FIG. 1 and FIG. 7, it is also possible to control the rolling state of the roller 210 by detecting the position of the movable member 300. Specifically, the adjustment mechanism 30 further includes a position sensor 550 disposed on the movable member 300 and connected with the controller 400. The position sensor 550 can detect the position of the movable member 300 in real time, and feedback the detection result to the controller 400. The controller 400 can determine the rotational direction and rotational speed of the roller 210 based on the detection result of the position sensor 550. In an embodiment, as shown in FIG. 1 and FIG. 8, the adjustment mechanism 30 further includes a gyroscope 560 and an accelerometer 570. The gyroscope 560 and the accelerometer 570 are both disposed on the movable member 300 and are all connected to the controller 400. The gyroscope 560 can detect the change in the orientation of the movable member 300, the accelerometer 570 can detect the magnitude of the acceleration of the movable member 300, and the controller 400 can determine the rotational direction and rotational speed of the roller 210 based on the detection results of the gyroscope 560 and the accelerometer 570. In the present embodiment, the gyroscope 560 may be independent from the accelerometer 570, and the accelerometer 570 may also be integrated in the gyroscope 560.

Figure 9:
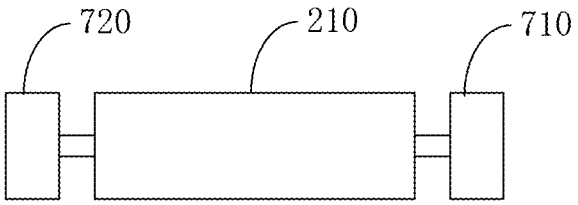
FIG. 9 is a schematic structural view of a roller and a reversing assembly of the cleaning robot shown in FIG. 1.

Further, in addition to the movable member 300 being capable of sliding back and forth with respect to the handle 100, the movable member 300 can also be deflected leftward and rightward relative to the handle 100. That is, the adjustment mechanism 30 can control the cleaning in addition to the movement of the cleaning body 20 in the front-rear direction. The cleaning body 20 performs commutation. For example, when the movable member 300 is deflected to the left front with respect to the handle 100, the cleaning body 20 will turn leftward and the like. Specifically, in an embodiment, referring to FIG. 1, FIG. 8, and FIG. 9, the cleaning body 20 further includes a reversing component. The reversing component includes a first direction wheel 710, a second direction wheel 720, a second driving mechanism, and a third driving mechanism. The roller 210 is disposed between the first direction wheel 710 and the second direction wheel 720, the second driving mechanism can drive the first direction wheel 710 to rotate, and the third driving mechanism can drive the second direction wheel 720 to rotate. The second driving mechanism and the third driving mechanism are both connected with the controller 400. The controller 400 controls the second driving mechanism to control the first direction wheel 710, and controls the third driving mechanism to control the second direction wheel 720. The differential rotation of the first direction wheel 710 and the second direction wheel 720 can achieve the turning commutation of the cleaning body 20.

Specifically in this embodiment, the first direction wheel 710 and the second direction wheel 720 are coaxially arranged, and the second drive mechanism and the third drive mechanism are both brushless motors. When the movable member 300 moves linearly, the controller 400 also controls the linear movement of the cleaning body 20. At this time, the rotational speed of the first direction wheel 710 is equal to the rotational speed of the second direction wheel 720. When the movable member 300 is deflected to the left front, the gyroscope 560 and the accelerometer 570 respectively send the orientation and the acceleration of the movable member 300 to the controller 400, and the controller 400 causes the first direction wheel 710 to rotate at a lower speed than the second direction. The rotational speed of the second direction wheel 7:20 is such that a forward left turn of the cleaning body 20 is achieved. When the movable member 300 is deflected to the right front, the controller 400 causes the rotational speed of the first direction wheel 710 to be smaller than the rotational speed of the second direction wheel 720, thereby achieving a forward turning right of the cleaning body 20. Similarly, when the movable member 300 is deflected to the left rear, the cleaning body 20 will turn left and right, and when the movable member 300 is deflected to the right rear, the cleaning body 20 will turn rightward.

In an embodiment, the working assembly 200 further includes a reversing wheel. When the cleaning body 20 is straight, the axis of the reversing wheel is parallel to the axis of the roller 210. When the cleaning body 20 turns, the angle between the axis of the reversing wheel and the axis of the roller 210 is set. The reversing wheel is connected with the movable member 300. When the movable member 300 is deflected with respect to the handle 100, the reversing wheel can be deflected together with the movable member 300 to realize the turning of the cleaning body 20. The connection between the reversing wheel and the movable member 300 is mainly a mechanical connection, and the movable member 300 can be connected with the hub of the reversing wheel through a connecting rod.

Figure 10:
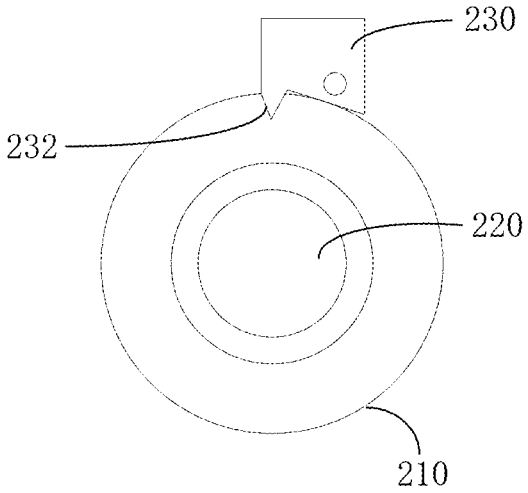
FIG. 10 is a schematic view of the structure of the roller, the first drive mechanism, and the water tank of the cleaning robot shown in FIG. 1.

It is worth mentioning that for the cleaning robot 10 of the present embodiment, the rotational speed of the first driving mechanism 220 is controlled between the first speed and the second speed, wherein the first speed is 60 revolutions per second and the second speed is 154 revolutions per second. In this range, the cleaning robot 10 can obtain reasonable cleaning performance. As shown in FIG. 1 and FIG. 10, in the present embodiment, the working assembly 200 further includes a water tank 230, a brush 240, and a garbage collection box 250. The water tank 230 is used for supplying the clean water to the roller 210 and for recovering the sewage absorbed by the roller 210. The brush 240 is disposed on one side of the roller 210 and is in contact with the surface of the roller 210. The garbage collection box 250 is used to collect garbage separated from the roller 210 by the brush 240.

The bottom wall of the water tank 230 is provided with a protrusion 232. The protrusion 232 is in contact with the roller 210, and the protrusion 232 can make the portion of the roller 210 abutting the protrusion 232 be recessed toward the axis of the roller 210 so that the protrusion 232 can squeeze out the sewage absorbed when the roller 210 cleans the ground, and the sewage is pushed out into the water tank 230 after being extruded.

In the present embodiment, the brush 240 can also rotate so as to facilitate the sweeping of the trash on the surface of the roller 210 and into the garbage collection box 250. The mechanism for driving the brush 240 to rotate may be an additionally provided motor or a first driving mechanism 220. The first driving mechanism 220 may be connected to the brush 240 through a gear pair or other transmission mechanism.

In order to increase the cleaning effect, the working assembly 200 includes two rollers 210, the axes of the two rollers 210 are parallel to each other, and the rotational directions of the two rollers 210 are the same. It can also be said that two rollers 210 are arranged at intervals in the front-rear direction. When the cleaning body 20 advances, the roller 210 located at the rear can clean the garbage still remaining on the ground after the roller 210 located at the front passes by, and achieve the purpose of secondary cleaning. Correspondingly, two brushes 240 are also provided, corresponding one-to-one to the roller 210. The axes of the two brushes 240 are located between the axes of the two rollers 210. and the rotational direction of the two brushes 240 is opposite one another. As shown in FIG. 1 as the viewing angle, regardless of whether the two rollers 210 rotate clockwise or counterclockwise, the brush 240 on the left side rotates counterclockwise, and the brush 240 on the right side rotates clockwise.

In the present embodiment, the work assembly 200 further includes a hearing roller 260 capable of supporting the garbage collection box 250 to increase the load-hearing capacity of the garbage collection box 250.

The technical features of the above-described embodiments may be combined arbitrarily. To make the description succinct, all the possible combinations of the technical features in the above embodiments are not described. However, as long as there is no contradiction in the combination of these technical features, all should be considered as described in this specification. The above-mentioned embodiments merely represent several embodiments of the present disclosure, and the description thereof is more specific and detailed, but it should not be construed as limiting the scope of the disclosure, it should be noted that, for those skilled in the art, several variations and improvements may be made without departing from the concept of the present disclosure, and these are all within the protection scope of the present disclosure. Therefore, the scope of protection of the present disclosure shall be subject to the appended claims.

The invention claimed is:

1. A cleaning robot comprising:

a cleaning body comprising a handle and a working assembly, wherein:

the working assembly is disposed at a first end of the handle, the working assembly comprises:

a first roller; and a first drive mechanism;

a water tank;

a first brush; and a garbage collection box, the first drive mechanism drives the first roller to rotate relative to the handle, the water tank provides clean water to the first roller and recovers sewage absorbed by the first roller, the first brush is disposed on one side of the first roller and is in contact with a surface of the first roller, and the garbage collection box is used to collect trash separated from the first roller by the first brush; and an adjustment mechanism connected with the first drive mechanism, wherein;

when a rotational speed of the first roller is between a first speed and a second speed, the adjustment mechanism is configured to adjust a rotational direction and the rotational speed of the first roller by controlling the first drive mechanism.

2. The cleaning robot according to claim 1, wherein:

the adjustment mechanism comprises a movable member and a controller, the movable member is disposed at a second end of the handle away from the working assembly, the movable member is movable relative to the handle, and when the handle is slid and the movable member slides relative to the handle, the controller controls a rolling state of the first roller based on a relative position of the movable member and the handle.

3. The cleaning robot according to claim 2, wherein:

the adjustment mechanism further comprises a gyroscope and an accelerometer, the gyroscope and the accelerometer are both disposed on the movable member, the gyroscope and the accelerometer are both connected to the controller, the gyroscope and the accelerometer are respectively configured to detect an orientation and an acceleration of the movable member to generate a detection result, and the controller controls the rolling state of the first roller according to the detection result.

4. The cleaning robot according to claim 3, wherein:

the cleaning body further comprises a reversing component, the reversing component comprises a first direction wheel, a second direction wheel, a second drive mechanism, and a third drive mechanism, the first roller is disposed between the first direction wheel and the second direction wheel, the second drive mechanism drives the first direction wheel to rotate clockwise or counterclockwise, the third drive mechanism drives the second direction wheel to rotate clockwise or counterclockwise, the second drive mechanism and the third drive mechanism are both connected to the controller, the first roller provides main power for forward and backward movement, and the first direction wheel and the second direction wheel provide power for steering.

5. The cleaning robot according to claim 2, wherein:

the working assembly further comprises a reversing wheel, the reversing wheel is located behind the first roller, an axis of the reversing wheel is parallel to an axis of the first roller when the cleaning body is moving straight, and when the cleaning body turns;

an angle between the axis of the reversing wheel and the axis of the first roller is set to generate a biasing force, the movable member is deflected relative to the handle, and the reversing wheel is connected with the movable member and deflected together with the movable member to achieve turning of the cleaning body.

6. The cleaning robot according to claim 2, wherein:

the movable member comprises a first sliding portion and a second sliding portion that are connected with each other, a groove is formed in the handle, the first sliding portion is inserted into the groove, and the second sliding portion is external to the groove.

7. The cleaning robot according to claim 6, wherein:

the adjustment mechanism further comprises a sensing component connected to the controller, the sensing component comprises a sensor head and a sensor band, the sensor head is disposed in the first sliding portion, the sensor band is located on a bottom wall of the groove, a plurality of nodes are arranged at intervals on the sensor band, and when the movable member slides relative to the handle, the sensor head corresponds to different nodes so that the controller changes the rolling slate of the first roller.

8. The cleaning robot according to claim 6, wherein:

the adjustment mechanism further comprises a first spring, the first spring is disposed in the groove, a first one end of the first spring and a sidewall of the groove are connected, and a second end of the first spring is connected to the first sliding portion.

9. The cleaning robot according to claim 8, wherein:

the adjustment mechanism further comprises a second spring, the second spring is disposed in the groove, the first sliding portion is located between the first spring and the second spring, and when the first spring is compressed, the second spring is elongated.

10. The cleaning robot according to claim 9, wherein:

the adjustment mechanism further comprises a first force sensor and a second force sensor, the first force sensor is disposed at the first end of the first spring, the second force sensor is disposed at a first end of the second spring, and the first force sensor and the second force sensor are both connected to the controller.

11. The cleaning robot according to claim 10, wherein:

both the first force sensor and the second force sensor are pressure sensors, or both the first force sensor and the second force sensor are tension sensors.

12. The cleaning robot according to claim 8, wherein:

the adjustment mechanism further comprises a first force sensor and a second force sensor, the first force sensor and the second force sensor are respectively disposed at the first end and the second end of the first spring, the first force sensor and the second force sensor are both connected to the controller, when the first force sensor is a pressure sensor, the second force sensor is a tension sensor, and when the first force sensor is the tension sensor, the second force sensor is the pressure sensor.

13. The cleaning robot according to claim 2, wherein the adjustment mechanism further comprises a position sensor disposed on the movable member and is connected to the controller.

14. The cleaning robot according to claim 1, wherein:

a bottom wall of the water tank defines a protrusion, the protrusion abuts the first roller, and a recess is defined where the protrusion abuts the first roller.

15. The cleaning robot according to claim 1, further comprising a load-bearing roller, wherein the load-bearing roller is configured to support the garbage collection box.

16. The cleaning robot according to claim 1, further comprising a second roller and a second brush, wherein:

an axis of the first roller is parallel to an axis of the second roller, and the rotational direction of the first roller is the same as a rotation direction of the second roller, an axis of the first brush and an axis of the second brush are located between the axis of the first roller and the axis of the second roller, and a rotational direction of the first roller is opposite to a rotational direction of the second roller.

* * * * *